US005289933A

United States Patent [19]

Streich et al.

[11] Patent Number: 5,289,933

[45] Date of Patent: Mar. 1, 1994

[54] COLLAPSIBLE CARGO CONTAINER

[75] Inventors: Roland Streich, Hailanderstrasse 25A, D-7460 Balingen-Zillhausen, Fed. Rep. of Germany; Falk Kühn, Rottenburg, Fed. Rep. of Germany

[73] Assignee: Roland Streich, Balingen-Zillhausen, Fed. Rep. of Germany

[21] Appl. No.: 871,311

[22] Filed: Apr. 20, 1992

[30] Foreign Application Priority Data

Apr. 25, 1991 [DE] Fed. Rep. of Germany ..... 4113438

[51] Int. Cl.[5] ..... B65D 7/24

[52] U.S. Cl. ..... 220/1.5; 220/4.28; 220/4.31

[58] Field of Search ..... 220/4.31, 4.28, 1.5

[56] References Cited

U.S. PATENT DOCUMENTS

| | | | |
|---|---|---|---|
| 949,204 | 2/1910 | Stiehl | 220/4.31 |
| 1,185,069 | 5/1916 | Curry et al. | 220/4.31 |
| 1,196,380 | 8/1916 | Moffett | 220/4.31 |
| 4,177,907 | 12/1979 | Funaioli et al. . | |
| 4,618,068 | 10/1986 | Born . | |

FOREIGN PATENT DOCUMENTS

| | | | |
|---|---|---|---|
| 875957 | 7/1971 | Canada . | |
| 0286271 | 10/1988 | European Pat. Off. . | |
| 3024707 | 2/1982 | Fed. Rep. of Germany . | |
| 3200216 | 8/1982 | Fed. Rep. of Germany . | |
| 3317221 | 11/1984 | Fed. Rep. of Germany . | |
| 8611553 | 7/1986 | Fed. Rep. of Germany . | |
| 3805981 | 9/1989 | Fed. Rep. of Germany . | |
| 88660 | 3/1967 | France . | |
| 0070800 | 1/1983 | France . | |
| 611899 | 10/1960 | Italy | 220/4.31 |
| 619733 | 3/1949 | United Kingdom . | |
| 2123789 | 2/1984 | United Kingdom . | |
| 2170185 | 7/1986 | United Kingdom . | |
| WO9103409 | 3/1991 | World Int. Prop. O. . | |

*Primary Examiner*—Joseph Man-Fu Moy

*Attorney, Agent, or Firm*—Frishauf, Holtz, Goodman & Woodward

[57] ABSTRACT

A collapsible cargo container, particular of rectangular or square cross section, has a bottom element, a top element, and side wall elements, which in the erected state for use are joined together by releasable plug-in connectors located in corner pillars at corner regions of the bottom and top elements. In the collapsed state for being shipped empty, the top element is joined to the bottom element with the same plug-in connectors, and the side wall. At least one door fits flush against adjacent side wall elements inwardly of the pillars, to permit flat folding of the container for shipment when empty.

27 Claims, 17 Drawing Sheets

COLLAPSIBLE CARGO CONTAINER

FIELD OF THE INVENTION

The invention relates to a collapsible freight container of rectangular or square cross section, with a bottom element, side wall elements and a top element, which are rigidly joined to one another in an erected state, and at least one closing part that can be opened and closed. Releasable plug-in connectors for connecting the bottom and top elements to the side wall elements are provided in the corner regions of the bottom and top elements.

BACKGROUND OF THE INVENTION

The problem of trash disposal has become increasingly important in recent years; economizing on packaging materials, such as boxes, foils, paper bags, and the like, which as a rule are used only once, has been recommended. Cardboard boxes, which in principle could be used several times, are basically discarded, because of the relatively high cost of return shipment and because of the danger of possible damage after the single use. The costs of disposal for industrial and commercial trash are rising rapidly.

There is accordingly a need for practical, repeatedly usable package that on the one hand is sufficiently stable and wearproof and on the other can be used so universally that it can replace the boxes currently used for many purposes. This is true typically for the textile industry, for instance, in which yarn packages in large quantities were previously shipped from yarn manufacturers to the yarn-processing facilities in cardboard boxes that were intended for only a single use; shipping them back again for re-use is not considered worthwhile, if for no other reason than the considerable amount of space they occupy.

Especially from the transcontainer industry, constructions for collapsible or foldable containers have become known, which can be changed from an erected position for use into a flat position for being shipped empty, in which latter position the space required for empty or return shipping is substantially reduced.

These transcontainers, whose dimensions and basic structural elements are standardized, are as a rule made of sheet steel. They are arranged so as to be moved with special hoisting tools, and their special embodiment is also dependent on the goods to be shipped.

In this kind of large-volume transcontainer or container, known from German Patent Disclosure Document DE-OS 33 17 221, the end and side walls are joined rotatably to a flat, pallet-like bottom element by hinges, so that after the top element is removed, they can be folded down onto the bottom element to put the container in the flat, empty shipping position. The top element is placed on the wall parts, which are folded flat down on one another, and firmly joined to them by bolts and straps. Because of the relatively great weight of the wall parts and top element, folding in of the wall part can be done only with the aid of hoisting tools, and the correct placement of the top element, such that the bolts used for fastening enter their proper holes, requires considerable care and skill on the part of workers. Moreover, the axes of the hinges of the various wall elements must be at a variable distance from the bottom face of the bottom element, to enable folding up its wall parts so that they lie flat. Aside from the fact that this can entail difficulties in terms of construction, a predetermined order in the folding process must also be adhered to, which once again means that trained workers are a precondition if damage to the hinges or wall parts is to be prevented.

In principle, the same comments apply to a collapsible transcontainer known from Canadian Patent 875,957, in which the opposed end walls are embodied as hinged doors, which to be folded down to the empty shipping position can be folded about their vertical hinge axes onto the outside of the associated side wall, so that they lie flat. In this transcontainer, special seals between the side walls and the top and bottom elements and the doors are additionally provided, in order to assure that the container interior is sealed off at least from splashing water.

In another collapsible cargo container according to ISO Standards, known from German Patent Disclosure Document DE-OS 38 05 981, each side wall is made up of three sections, joined together by hinges, while the end walls on the container are supported movably in such a way that they can be moved out of the normal closing position into a position in which they can be slipped under the top of the container. To collapse the container, the side wall sections are folded inward about their hinge axes in accordion-like fashion, so that in the empty shipping position, the top part, the end walls, the middle and bottom sections of the side walls and the bottom element rest on one another in layered fashion. The container can be folded down can be done only by means of a hoisting tool that engages the corner sockets of the top part, and in view of the danger of accidents, considerable care must be taken.

It is also known from German Utility Model DE-GM 86 11 553, in a transcontainer in which the end and side walls are joined to the bottom element by hinges, to form the top element in two parts as well and connect it to the side walls by hinges. Doors provided in the end walls are formed such that in the process of collapsing the container, they can be folded outward, flat on one another. In this transcontainer, a tubular frame with coating sheets is used; the wall parts, in the erected position for use, are locked together with lever closures. The many hinge axes of these transcontainers impair their stability in the erected state and make satisfactory sealing of the container interior appear possible only with difficulty. Aside from that, it is difficult and inconvenient to manipulate this transcontainer in the process of collapsing it.

Finally, a cargo container for small loads or the like, constructed in lightweight fashion, is known from German Patent Disclosure Document DE-OS 30 24 707; the invention is based on this container, in which the use of hinges as connection means between the bottom and top elements and the side wall elements is dispensed with. Both the bottom and top elements and the side wall elements here comprise aluminum sectional frames and thin aluminum panels joined to them, which are optionally provided with beads or integrally molded reinforcement ribs. The bottom element and the top element are joined together in spaced-apart fashion by vertical pillars on which the intrinsically stable side walls are fixed; the pillars on the bottom element and on the top element are detachably connected by means of cuboid corner parts that have protrusions that protrude into hollow spaces in the corner pillars, which are embodied as hollow profile sections. Additional fastening screws keep these plug-in connectors, located at the corners of the bottom and top elements, together.

Assembling and disassembling the cargo container as needed, to put it in the erected position for use or the flat position for being shipped empty, involves relatively many separate parts. Aside from the fact that this makes the process of assembly and disassembly itself relatively time-consuming and inconvenient, special precautions must also be taken so that the loose individual parts will not be lost during the empty shipment.

THE INVENTION

It is an object of the invention to create a cargo or shipping container that as much as possible is free of the above disadvantages of transcontainers, can be produced economically with a low weight, is distinguished by a strong, easy-care construction, and is suitable for packaging the most various kinds of goods; at the same time, it should be simple to convert to a collapsed empty shipment state.

Briefly, plug-in connectors, in a collapsed, empty shipment condition, are arranged to connect the top element to the bottom element with side wall elements located between them, and in this empty shipping condition the at least one closing part is accommodated resting broadside on one of the side wall elements.

This cargo container is distinguished by relatively few individual parts, which make easy assembly possible, especially since the individual parts are put together by being plugged into one another.

In the collapsed empty shipping condition, the side walls and any doors and the like are accommodated between the bottom and top elements, and since the top element is firmly joined to the bottom element via the plug-in connectors, the entire assembly forms a flat, stable "package" that requires little space in shipping. There are no loose individual parts; the side wall elements can be stacked on the bottom element in any arbitrary order. Because a hinge connection between the side walls and the bottom or top element is dispensed with, it is also assured that the bottom face of the cargo container pointing toward the container interior can be embodied as entirely flat; that is, variably high striplike retaining elements for hinge axes and the like do not have to be provided on the periphery. With the top element removed and the side wall elements removed, the bottom element can even be used directly as a pallet, if necessary. The bottom and top elements can also therefore be combined with wall elements of various heights, to adapt the height of the cargo container as needed to packaged goods of various heights.

In a preferred embodiment, the novel cargo container may be formed such that its side wall elements and/or the bottom and/or the top elements are at least substantially made of plastic. Fiber-reinforced plastics are especially suitable for this purpose, that is, both thermoplastics and thermosetting, or duroplastics, which can be processed for instance by conventional compression molding methods. However, it is also possible for various elements or all the elements to be made by plastic injection molding. The elements may be structured in single layers or multiple layers, and optionally may be entirely or partially of polyurethane foam. However, elements that were produced by different production processes may also be combined with one another, if that has advantages in view of price or production considerations. The simple structure of the novel cargo container enables manufacture to especially accurate dimensions in a manner appropriate for tools, without significant postmachining; it assures a stable construction, and as a rule no surface protection is necessary, since the plastic material can be dyed in any arbitrary color and is also largely impact-proof and scratch-proof, depending on the material selected.

Naturally some other material, if it should appear appropriate for the intended use, can intrinsically be used to produce the novel cargo container. For instance, the container or at least some of its elements may be made of lightweight metal or sheet metal in general, or even of wood, and composite materials may also be used. Because of its light weight, it can be assembled and disassembled without difficulty, without using hoisting tools. It is suitable for packaging and shipping practically any arbitrary goods, including foodstuffs, glass and porcelain products, and so forth. Especially in the textile industry, such cargo containers can be advantageously used for packaging in the shipment of yarn packages of any kind. The cargo containers may also be used for storage purposes.

Particularly when made of plastic, the cargo containers can also be stored out in the open without problem for relatively long periods of time, and depending on the goods to be shipped, it is possible to seal off the container interior against splashing water or dust without major effort or expense.

Further characteristics and advantages of the novel cargo container will become apparent from the ensuing detailed description of an exemplary embodiment of the subject of the invention, which is shown in the drawing.

DETAILED DESCRIPTION

Figure 1:
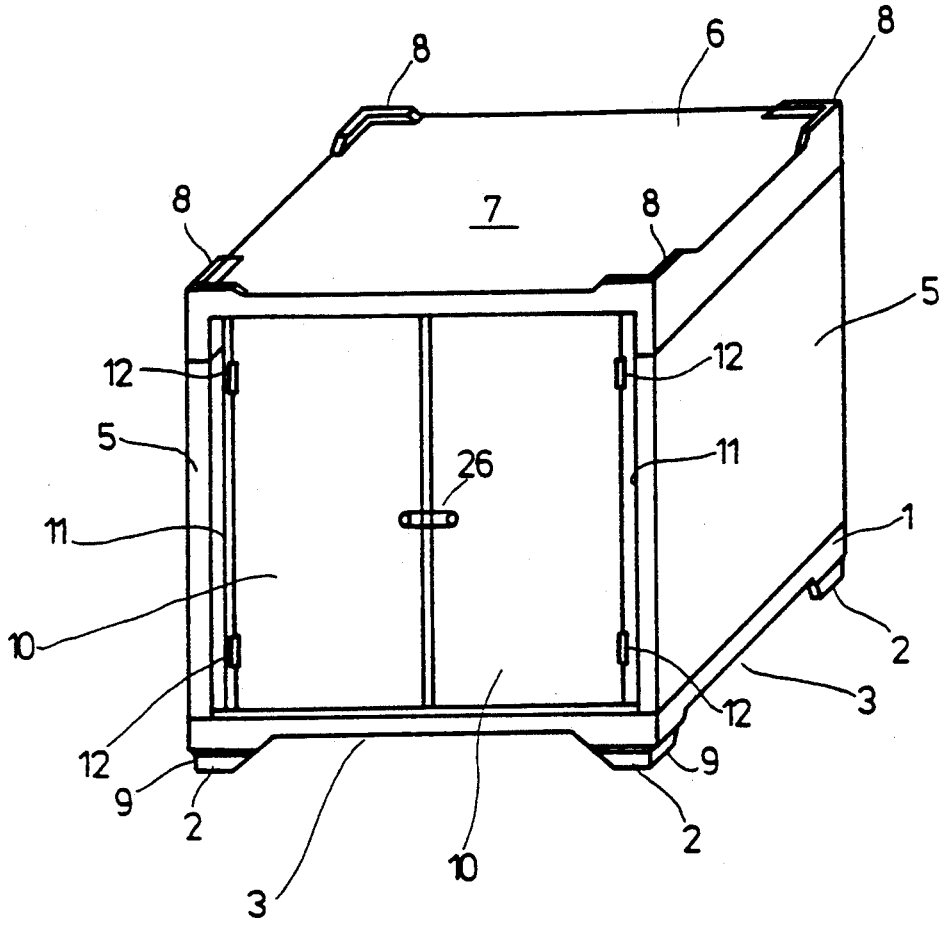
FIG. 1 is a perspective, schematic view of a cargo container or small container according to the invention, in the closed state.

The cargo container or small container shown in FIGS. 1-7 has a substantially cuboid or parallelepiped shape, with flat outer surfaces at right angles to one another. For the sake of easier comprehension, it is shown in these drawings, in various states, only in terms of its basic structure; individual structural details will then be explained in conjunction with the other drawing figures.

The cargo container has a substantially rectangular, flat, platform-like bottom element 1, which is provided in its corners with four angular feet 2 to stand on, which a space 3 left open between each of the feet that makes it possible to lift the cargo container with a forklift, for example. On opposed sides, two substantially parallel side wall elements 5 are mounted on the flat bottom face 4 (FIG. 2) of the bottom element 1, remote from the feet 2; the side wall elements 5 in turn carry a top element 5, which is flush on the periphery with the side walls 5. The top element 6 is embodied with a flat outer top face 7 and in its four corners has angle strips 8, protruding past the top face 7, which in turn serves as corner reinforcements for the top element 6 and on the other hand act as guide means for the feet 2 of an identical type of cargo container stacked on top, as can be seen from FIG. 2. To this end, the spacing between opposed inside faces of the angle strips 8 is such, taking into account the necessary play corresponding to the spacing between the associated opposed outer faces 9 of the likewise angled feet 2, that when cargo containers are stacked on one another, the top container is properly guided laterally.

On its front and rear face end, the cargo container is closable with closing parts, in the form of two doors or door halves 10, which can be swiveled about vertical hinge axes and are each attached to elongated, striplike hinge elements 11, which in turn are joined to the side wall elements 5 via hinges, not shown in detail in FIGS. 1-7. The hinges serving to pivotably support the doors 10 on the hinge elements 11 are identified by reference numeral 12.

Figure 2:
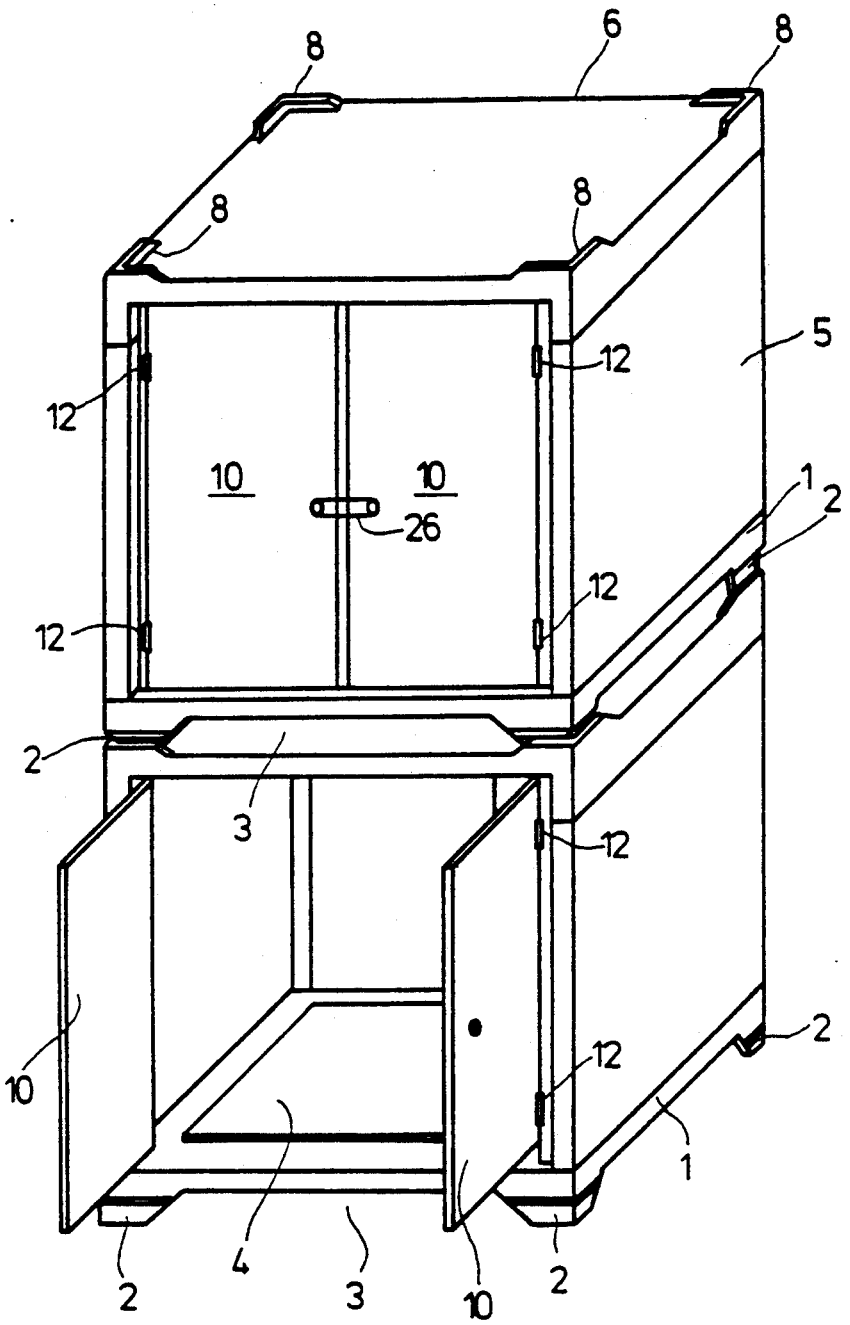
FIG. 2 shows the cargo container of FIG. 1 in the opened state, with a second cargo container of the same type, but in the closed state, stacked on it.

As FIG. 2 in particular shows, the doors 10 may also be selectively opened or closed at any time even when the cargo containers are in a stacked arrangement, so that the containers can be loaded or unloaded without hindrance; this may be advantageous especially if the cargo containers are used in the warehouse or as containers for provisions. The opening angle of each door or door half 10 is approximately 90° to 100°; depending on how the hinge flaps forming the hinges 12 are embodied, and these hinge flaps may optionally also have two hinge axes, an opening angle of 180° and more is also attainable, should that be necessary in an individual case.

The cargo container shown in the erected state for use in FIGS. 1 and 2 is collapsible. To enable this collapsibility, plug-in connectors are provided in the corner regions of the bottom and top elements 1 and 6 in order to join the wall elements 5 to the bottom and top elements; the structure of these connectors can be seen in detail in FIGS. 3 and 6, in particular:

The top element 6 has downwardly protruding, molded-on, striplike side parts 14, associated with the side wall elements 5 and in the extension of which, in the four corners of the top element 6, four parallel protrusions 15 of rectangular cross section are provided. Receptacles 16, likewise of rectangular cross section, are associated with the protrusions 15 that protrude from the top part 6, which in turn is of essentially U-shaped cross section. The receptacles are formed by the inner profile of four profile sections 17 of substantially rectangular or square cross section, which act as pillars and in pairs each define one side wall element 5 on opposed face ends. The profile sections 17 act as pillars; they absorb loads that may act vertically from above on the cargo container, for instance during stacking. They also effect a reinforcement and stabilization of the flat, thinner side wall panels 8 located between each two profile sections 17.

The profile sections 17, in a modified embodiment, may also be in the form of cylindrical tubes or profiled tubes or have some other cross sectional shape; it is also possible to use open profile sections. For instance, in the form of metal profile sections, they may be embedded in the side wall elements 5 which are for instance of plastic, but the arrangement may also be such that they are made directly from the material of the side wall elements 5. It should be noted that in principle embodiments are also possible in which the profile sections do not extend over the entire height of the side wall elements 5 but instead are replaced by striplike elements of shorter length, adjoining the regions of the upper and lower periphery of the side wall elements 5.

On the side opposite the receptacles 16, each wall element 5 is provided with two protrusions 19, likewise of rectangular cross section, which are coaxially aligned with the receptacles 16 and are essentially formed identically to the protrusions 15 of the top part 6. The protrusions 19, in the exemplary embodiment described, are pushed into the hollow space of the profile sections 17 and fixed in it. As can be seen especially from FIG. 6, holes 20 of rectangular cross section for protrusions are formed in the bottom element 1, in the region of its corners 4; they serve to receive the lower protrusions 19 of the side wall element 5 and are formed so as to fit these protrusions 19.

Figure 3:
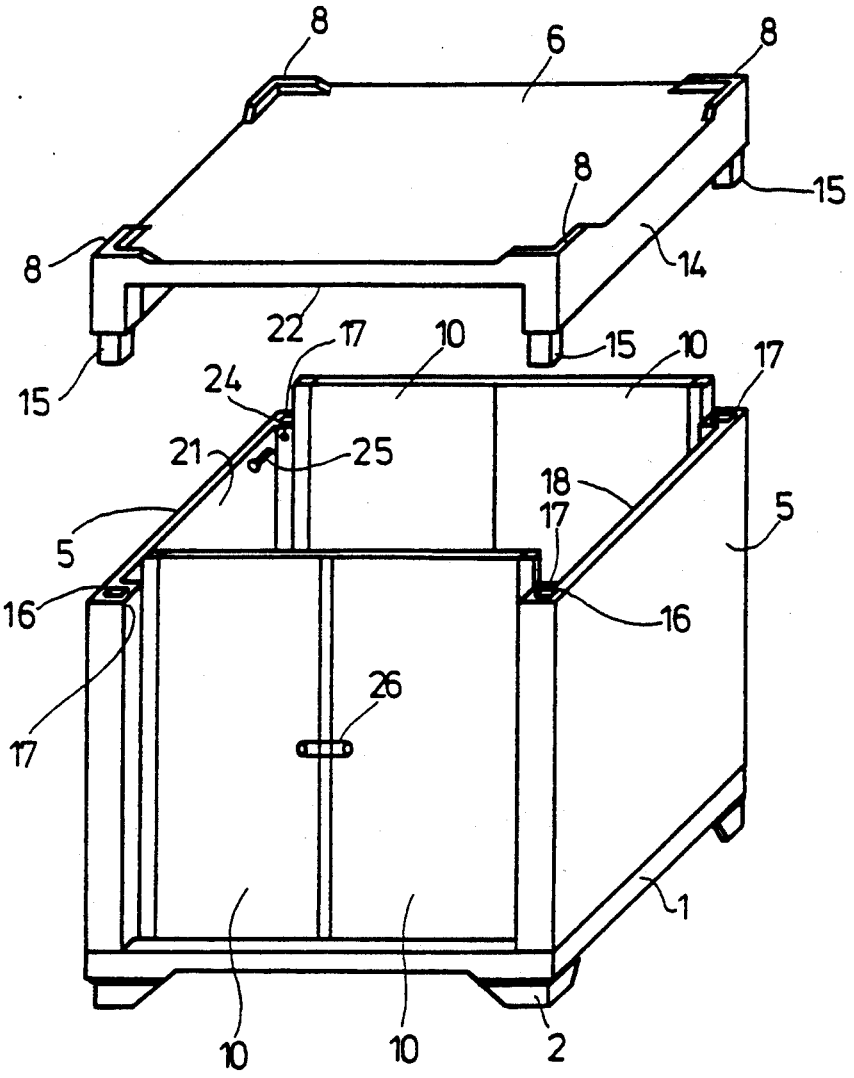
FIG. 3, in a schematic perspective view, shows the cargo container of FIG. 1 with the top part removed.
Figure 5:
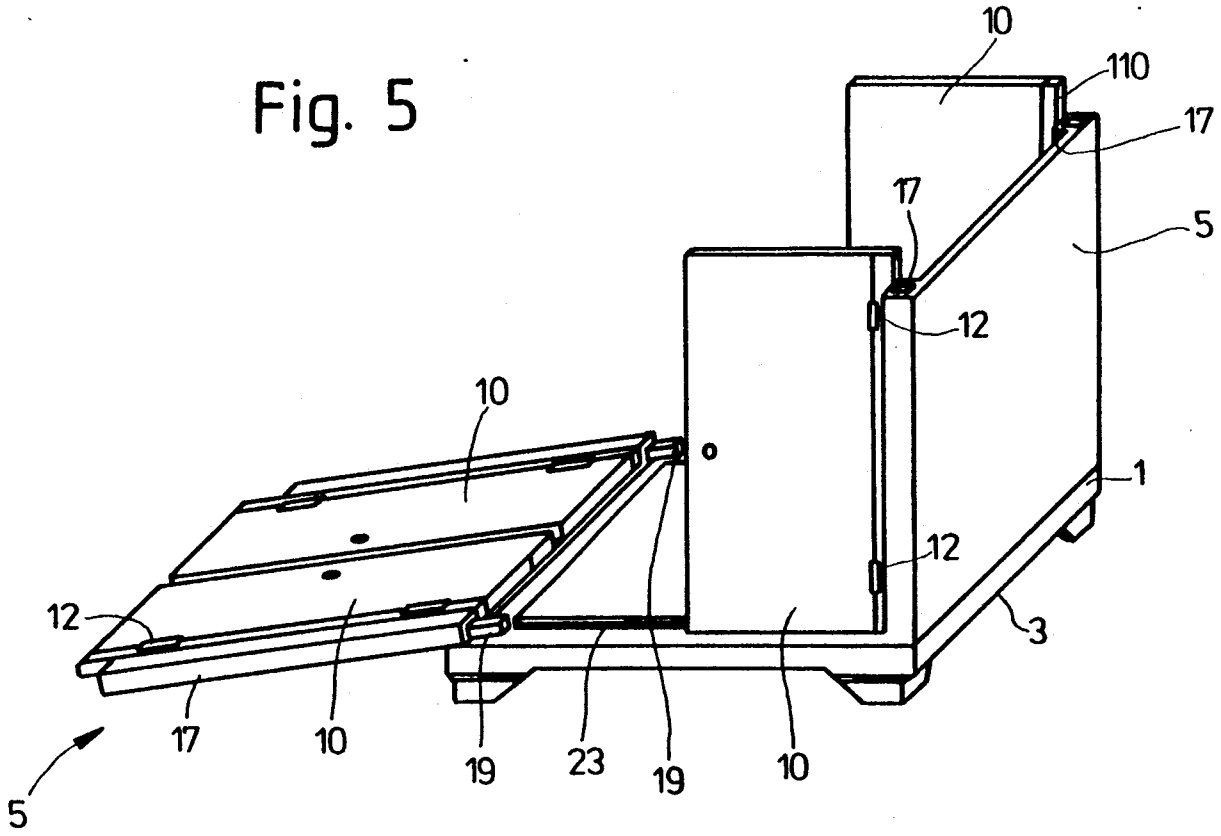
FIG. 5 is a schematic perspective view of the cargo container of FIG. 4, with a side wall element folded down.

FIGS. 3, 5, for instance, show that the profile sections 17 located with their face end at the side wall elements 5 are located such that they protrude inward past the otherwise flat and smooth inner wall face 21 of the wall elements 5, in such a way that between them, together with the inner wall face 21, they each define a channel-like, recessed space and lend the entire wall element 5 an approximately U-shaped cross-sectional form. Each outer wall of the wall elements 5 is smooth; however, it may also be profiled or shaped in some other way. This is also applicable to the inner face of the wall elements 5 and of both the bottom and top elements 1 and 6.

It should be noted in this connection that naturally other embodiments are also possible, in which the profile sections 17 protrude toward the outer wall of the wall elements 5 past at least part of their height, or form parts of a stable, closed frame in which wall panels are inserted or molded in.

The hinge strips 11, on which the doors 10 are attached so that they can be swiveled outward about a first vertical hinge axis, are in turn supported on the profile sections 17 such that they can be folded inward about a second vertical pivot axis, so that the doors 10 along with the hinge strips 11 can be folded in, in the manner apparent from FIG. 5, into the space, defined by the two profile sections and the inner face 21, of the associated side wall element 5. The extent to which the profile sections protrude past the inner face 21 is essentially equivalent to the thickness of the doors 10, so that in the folded-in state of the doors 10, shown on the left in FIG. 5, a substantially continuous, flat inner side of the side wall element 5, which in this state is substantially panel-like, results. This can also be readily seen from FIG. 4, where both side wall elements 5 are shown with sunken, folded-in doors 10.

The doors 10 are greater in height (FIG. 3) than the side wall elements 5. They stand on the flat bottom face 4 of the bottom element 1, with a play that is necessary for movement; on its top edge, in the erected state (FIG. 1), the top element 6 adjoins it, with a closure face 22 (FIG. 3) that is more deeply recessed than its side walls 14. Inwardly protruding stop means for the doors 10 are located on the flat bottom face 4 of the bottom element 1 and optionally on the closure face 22 of the top element 6 as well; in the present case, these means are formed by an encompassing stop strip 23 (see FIG. 4), the precise shape of which will be explained in further detail below in conjunction with FIGS. 12 and 13.

The manipulation of this cargo container as described thus far is performed as follows:

In the erected state for use, as shown for example in FIGS. 1 and 2, the bottom and top elements 1 and 6 are put together with the side wall elements 5 via the protrusions 15, 19. The protruding connections in the corners of the bottom and top elements 1 and 6 are secured by locking devices, which have aligned bores 24 (see FIG. 3), provided for instance in the profile sections 17 and protrusions 15, 19; securing pins suggested at reference numeral 25, optionally retained in captive fashion by a securing chain, may be inserted into these bores 24. The doors 10 may be selectively closed or opened, and latching devices suggested at 26 in FIG. 3 may be provided on the doors 10.

Figure 4:
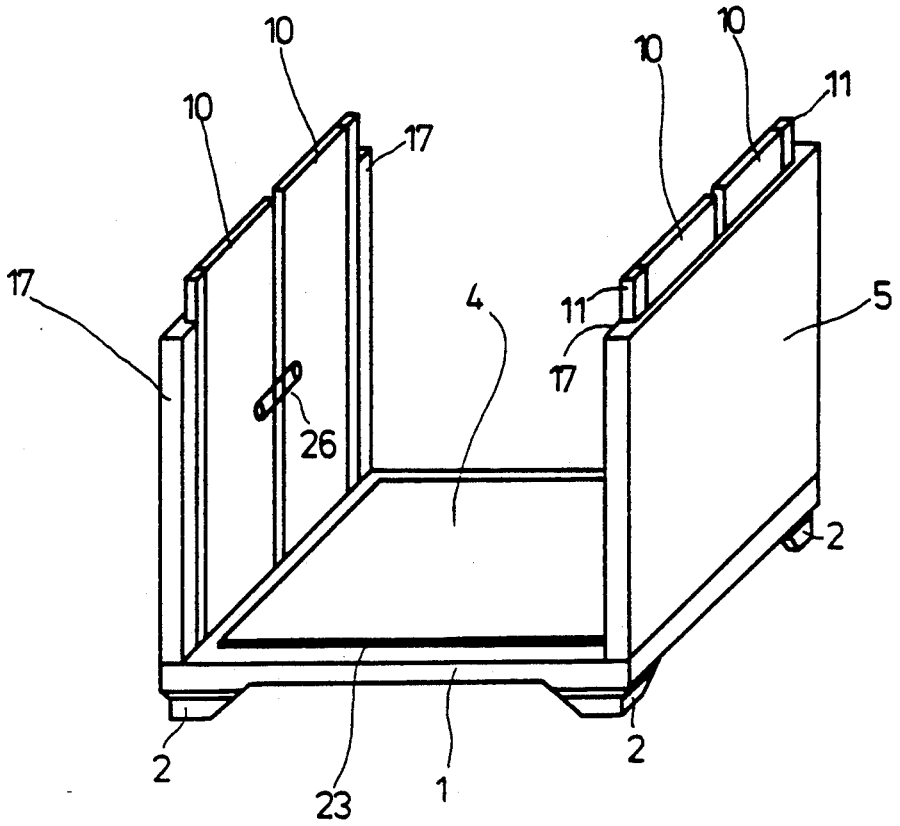
FIG. 4 is a schematic perspective view of the cargo container of FIG. 1, without a top part and folded-in doors.

Depending on the intended use, the cargo container may also, once the top element 6 has been removed, be used in the manner of a pallet in the state shown in FIG. 4, in which the doors 10 have been folded into the channel-like indentations in the side wall elements 5; loading and unloading can be done both from either face end or from above. Naturally, the top element 6 may also be placed on the cargo container in the state shown in FIG. 4, or may be put in place after loading, for example, to name one further variant use. The folded-in doors 10, along with the profile sections 17 and the bottom face 4, form flat inside surface regions for the containers used in this way; this makes it easier to introduce lumpy goods, for example.

For folding the doors 10 into the position of FIG. 4, either the side wall elements 5 must be lifted somewhat, or the doors 10 must be supported so as to be limitedly longitudinally displaceable in their hinges 12, as will be described in further detail below, so that they can get past the stop strip 23 of the bottom element 1. Another way to do this would be for the hinge elements 11 in turn to be limitedly displaceable relative to the side wall elements 5 along their hinge axis.

It should be noted in principle at this point that instead of the embodiment of the doors 10 as shown with two leaves, a single-leaf door construction would naturally also be possible, in which the door would then be attached to only one of the side elements, via a hinge element 11 or the like.

In each case, however, the cargo container can be loaded not only through the doors 10 but also from above, once the top part 6 has been removed, as shown in FIG. 3, should that be advantageous in an individual case.

Figure 7:
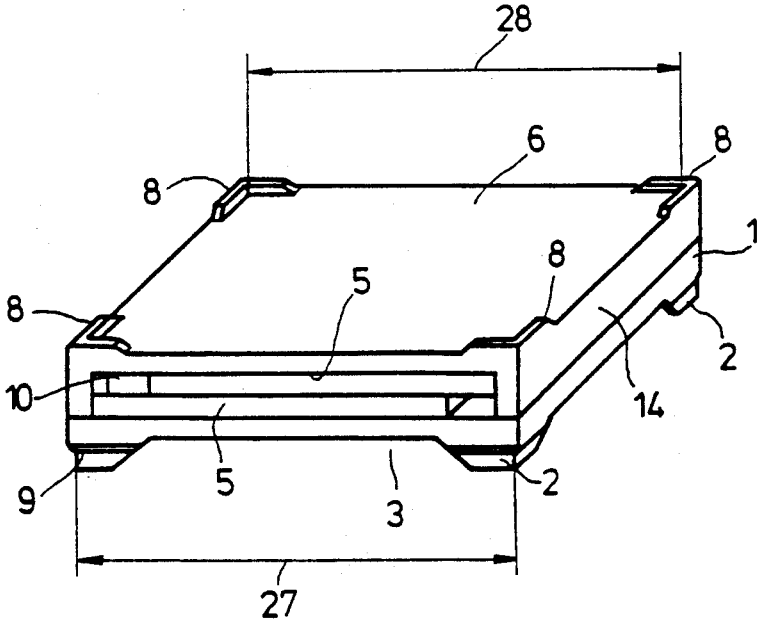
FIG. 7 is a schematic perspective view of the cargo container of FIG. 1, in the collapsed state for shipment empty.

Especially for return shipment, the empty cargo container can be converted to a flat empty shipment position with only a few manipulations, as shown in detail in FIG. 7. To this end, once the securing pins 25 are loosened, the top element 6 is removed (FIG. 3), whereupon the side wall elements 5 are disconnected from the bottom part 1 and the doors 10 are folded inward (FIG. 5), so that they rest flat, broadside, in sunken fashion, on the inside of the wall elements 5.

Figure 6:
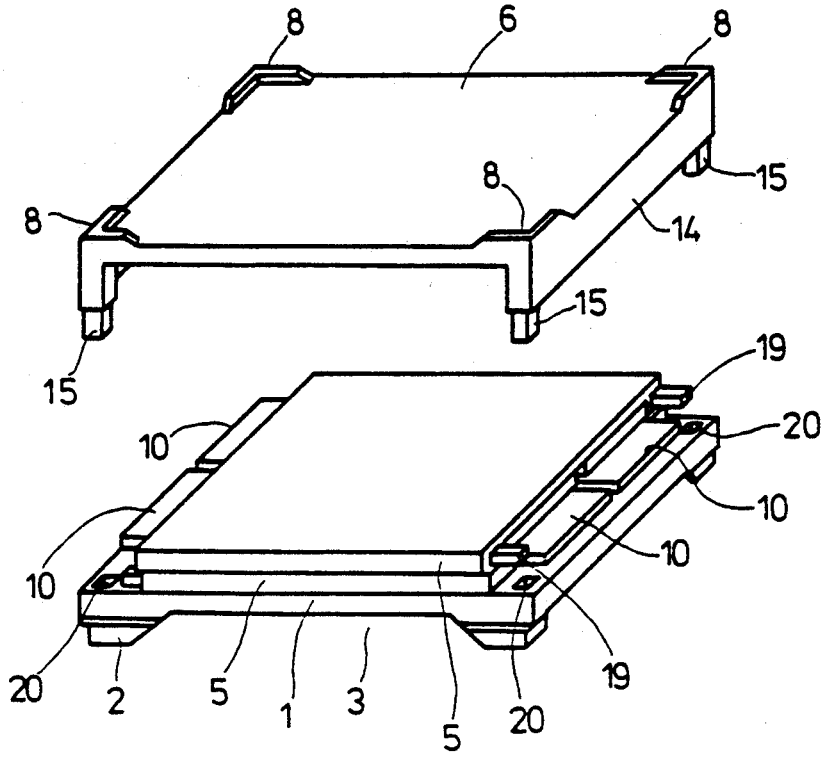
FIG. 6 is a schematic perspective view of the cargo container of FIG. 1, with a side wall element laid on the bottom element.

The wall elements 5, which are now substantially in panel-like form, along with the folded-in, sunken doors 10 are then simply laid flat one on top of the other onto the bottom element 1, in the manner seen from FIG. 6; the order in which this is done is of no importance.

The top element 6 is now inserted by its protrusions 15 into the holes 20 for these protrusions in the bottom element 1, resulting in the compact, flat unit that can be seen in FIG. 7, in which the top element 6 is directly, rigidly joined to the bottom element 1, and the side wall elements 5 with the folded-in doors 10 are retained in captive fashion, e.g. they cannot get lost, between the top element 6, fitting over them and having an approximately U-shaped cross section, and the flat bottom element 1.

In this flat, panel-like state shown in FIG. 7, the collapsed cargo container requires only approximately one-fifth as much space as the cargo container in its erected position for use shown in FIG. 1. The flat, compact "package" as shown in FIG. 7 can also be shipped as is in an upright position; a plurality of such packages can also be stacked. Since as already noted the spacing, marked by reference numeral 27 in FIG. 7, between the parallel outer surfaces of the feet 2 is somewhat shorter than the associated spacing 28 between opposed inside faces of the angle strips 8 of the top element 6, proper lateral guidance of the stacked cargo containers is assured even in the collapsed state, while the stacking process is simultaneously facilitated.

Re-erecting the cargo container from the collapsed state shown in FIG. 7 is done in reverse of the process described above. Since the top element 6 and the bottom element 1 are joined to the wall elements 5 only by plug-in connectors, which are very stable and easy to manipulate, changing the cargo container from the state for use into the empty shipment state and vice versa requires merely a few manipulations, which can readily be performed even by unskilled workers.

Various structural details of the cargo container, thus far described in conjunction with FIGS. 1–7 merely in terms of its basic structure and mode of operation, will now be described:

As a rule it is useful to join the bottom element 1 or top element 6 in captive fashion to the wall element 5, in such a way that converting the cargo container from the position for use to the empty shipment state and vice versa can be done without releasing the corresponding connection means. In a particularly simple and practical embodiment, this can be done by way of example in the manner shown in FIGS. 8–10:

Two flat straps 29 are rotatably supported by suitable fastening screws 30 on the face end of the bottom element 1, next to the doors 10. Each strap 29 has an oblong slot 31, which is engaged by a cap screw 32 that is secured axially parallel to the fastening screw 30 on one or the other wall element 5, in the region of its profile section 17.

Figure 8:
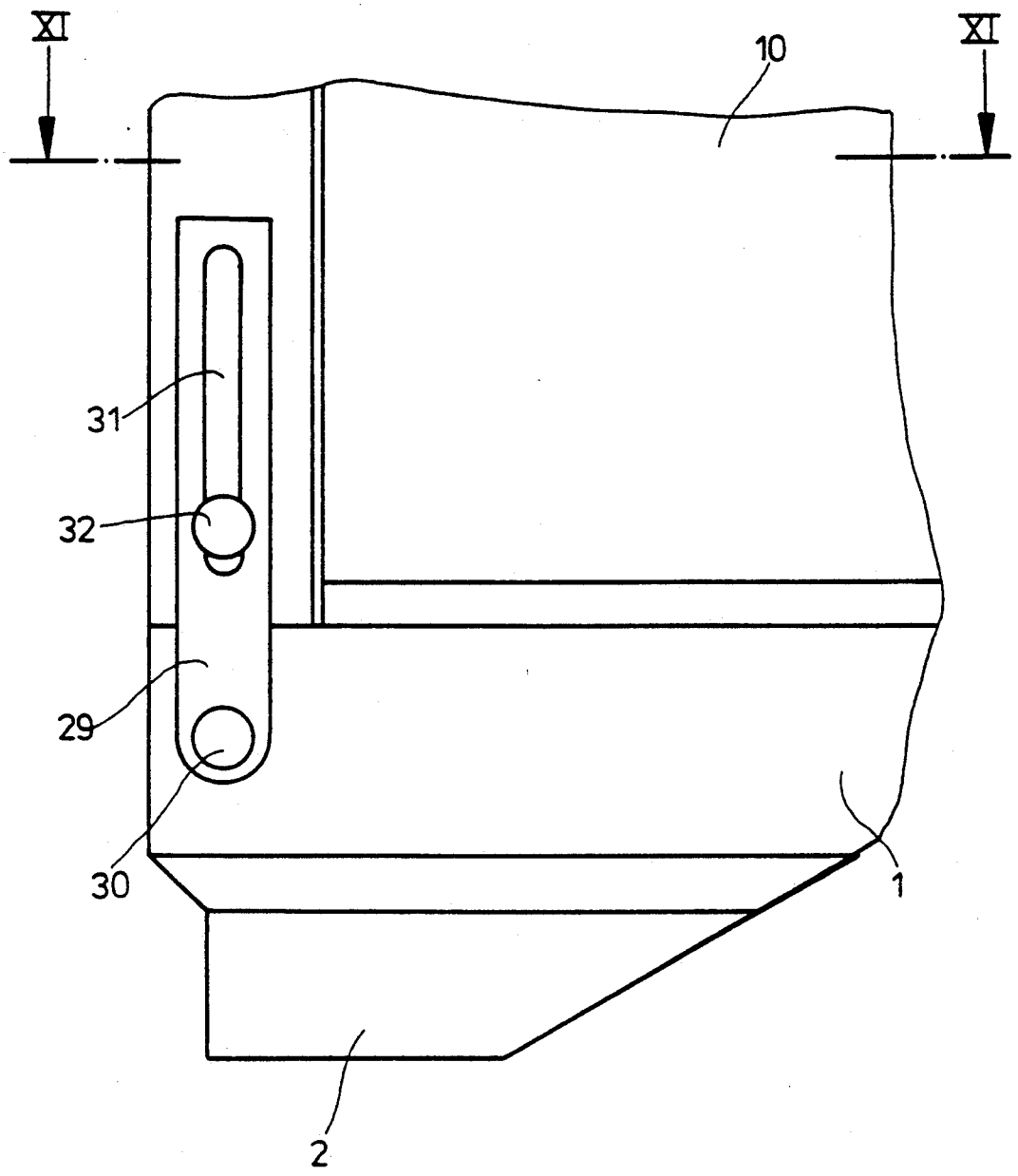
FIG. 8 is a detailed view, seen from the side and on a different scale, of the cargo container of FIG. 1, showing a detail in the region of the bottom element.
Figure 9:
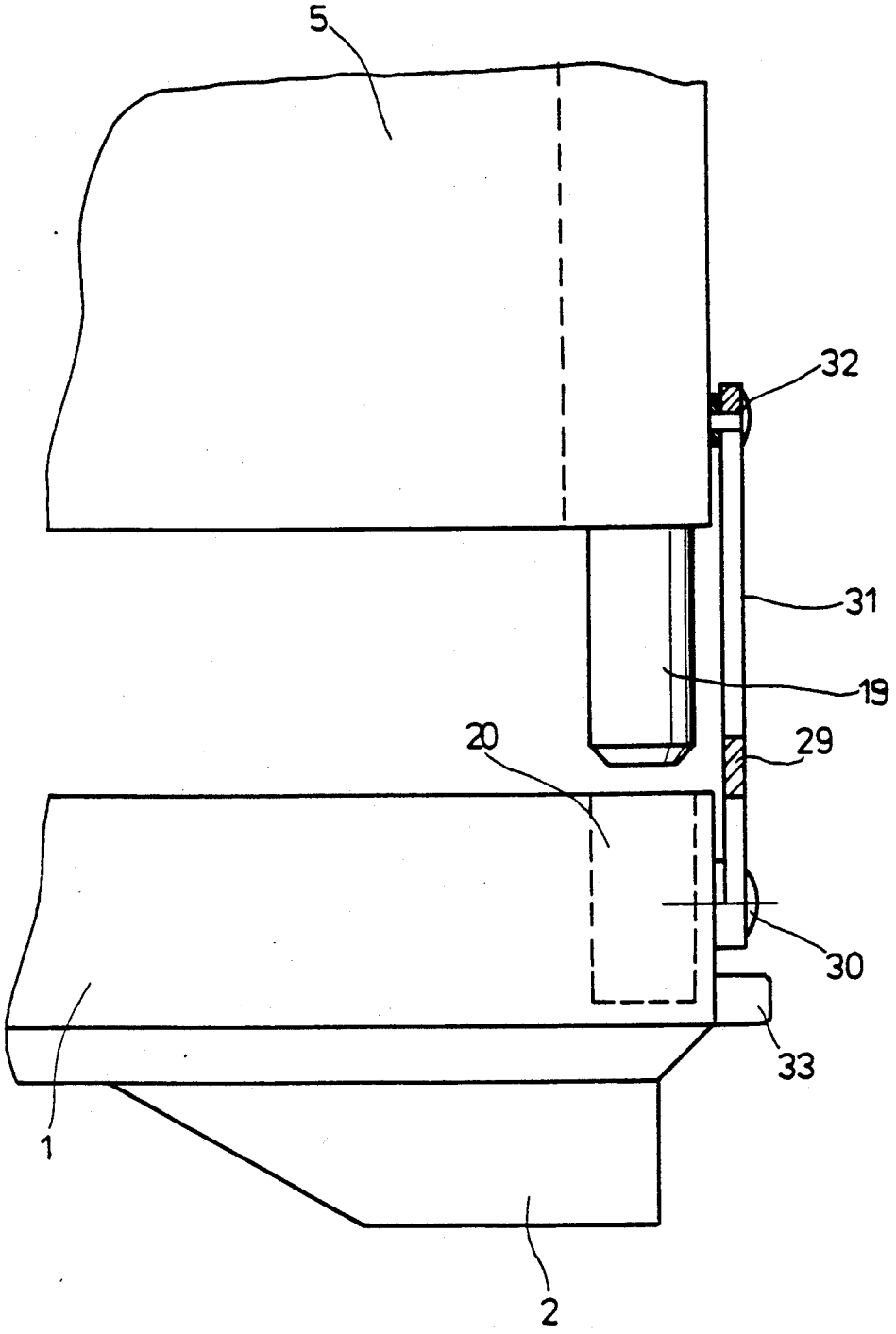
FIG. 9, in a different side view, shows the arrangement of FIG. 8, in a partially disassembled state.
Figure 10:
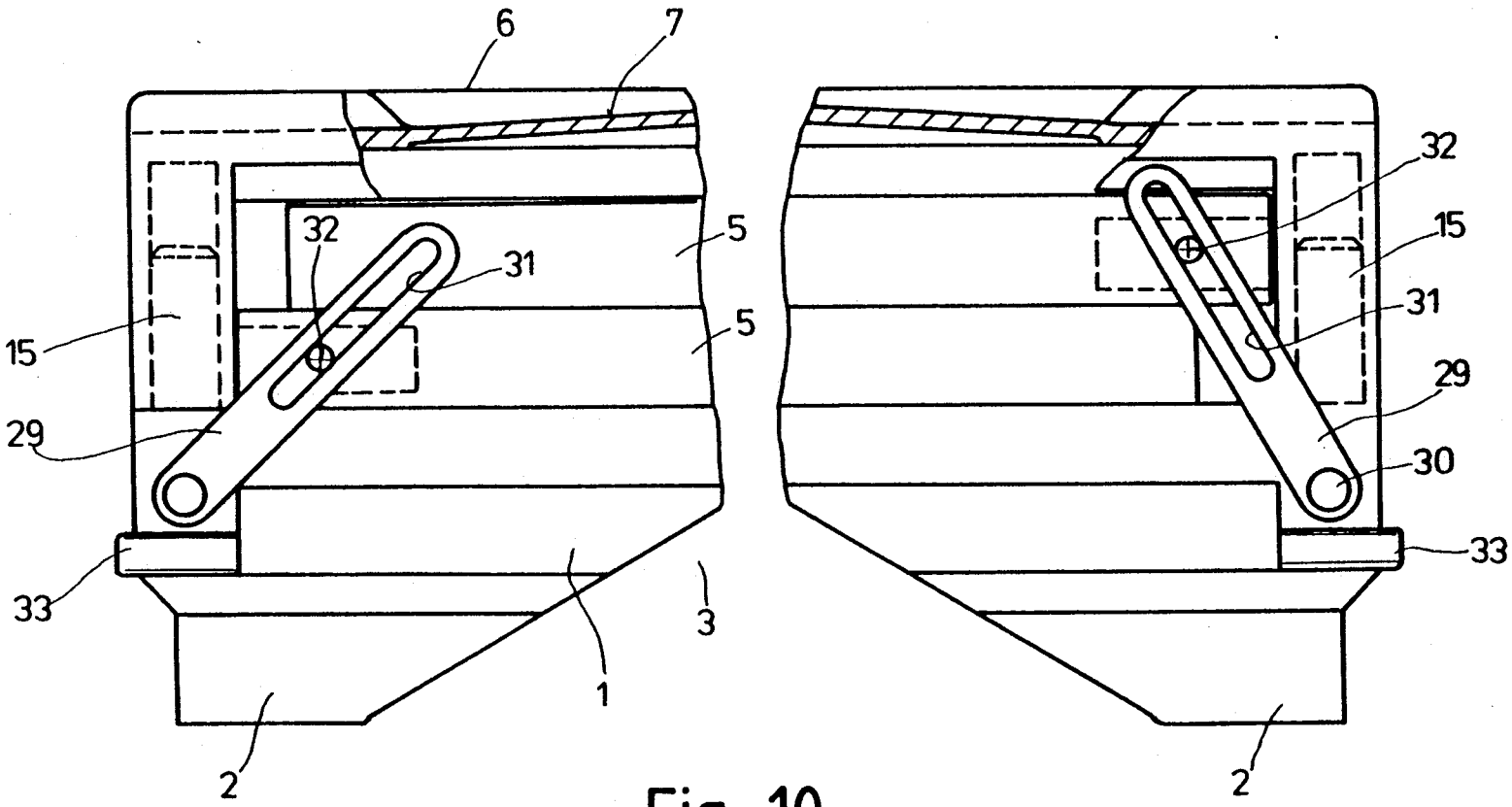
FIG. 10 is a side view of the arrangement of FIG. 8 corresponding to FIG. 7, in the collapsed state for empty shipment.

A comparison of FIGS. 8 and 9 shows that the length of the straps 29 and their oblong holes 31 is selected such that beginning at the position for use shown in FIG. 8, the applicable side wall element 5 can be raised far enough that its protrusions 19 are lifted out of the holes 20 (FIG. 9). The side wall elements 5 can then be folded flat onto the bottom element 1 in an arbitrary order, as shown in FIG. 10. The straps 29 then assume a suitable oblique position. In addition to their function already described of joining the bottom element 1 to the wall elements 5 in captive fashion, the strap 29 at the same time also fulfills a task of guiding the wall elements 5 when they are slipped onto the bottom element 1. In the collapsed empty shipping state of the cargo container shown in FIG. 10, they also form an additional lateral securing means for the side wall elements 5 located between the U-shaped top element 6 and the bottom element 1.

Laterally protruding impact absorber strips 33 are provided on the bottom element 1 in the region of its corners; they may optionally also comprise some elastic material, such as rubber. They protrude laterally past the straps 29, in the manner seen from FIG. 9, so that they protect the straps toward the outside, while simultaneously providing protection for the outer surfaces of the wall elements 5 against scratches and damage.

However, it would in principle also be possible to dispose the straps 29 in sunken fashion on the bottom element 1 and wall elements 5, if these elements are made with suitable recesses.

Alternatively, it would also be possible for the straps 29 to be rotatably fastened not to the bottom element 1 but rather to the top element 6 by means of the fastening screws 30, in a corresponding manner, so that in the course of collapsing the cargo container, the wall elements 5 are inserted into the top element of U-shaped cross section, and then the bottom element 1 is slipped onto the upwardly pointing protrusions 15 of the top element.

Figure 13:
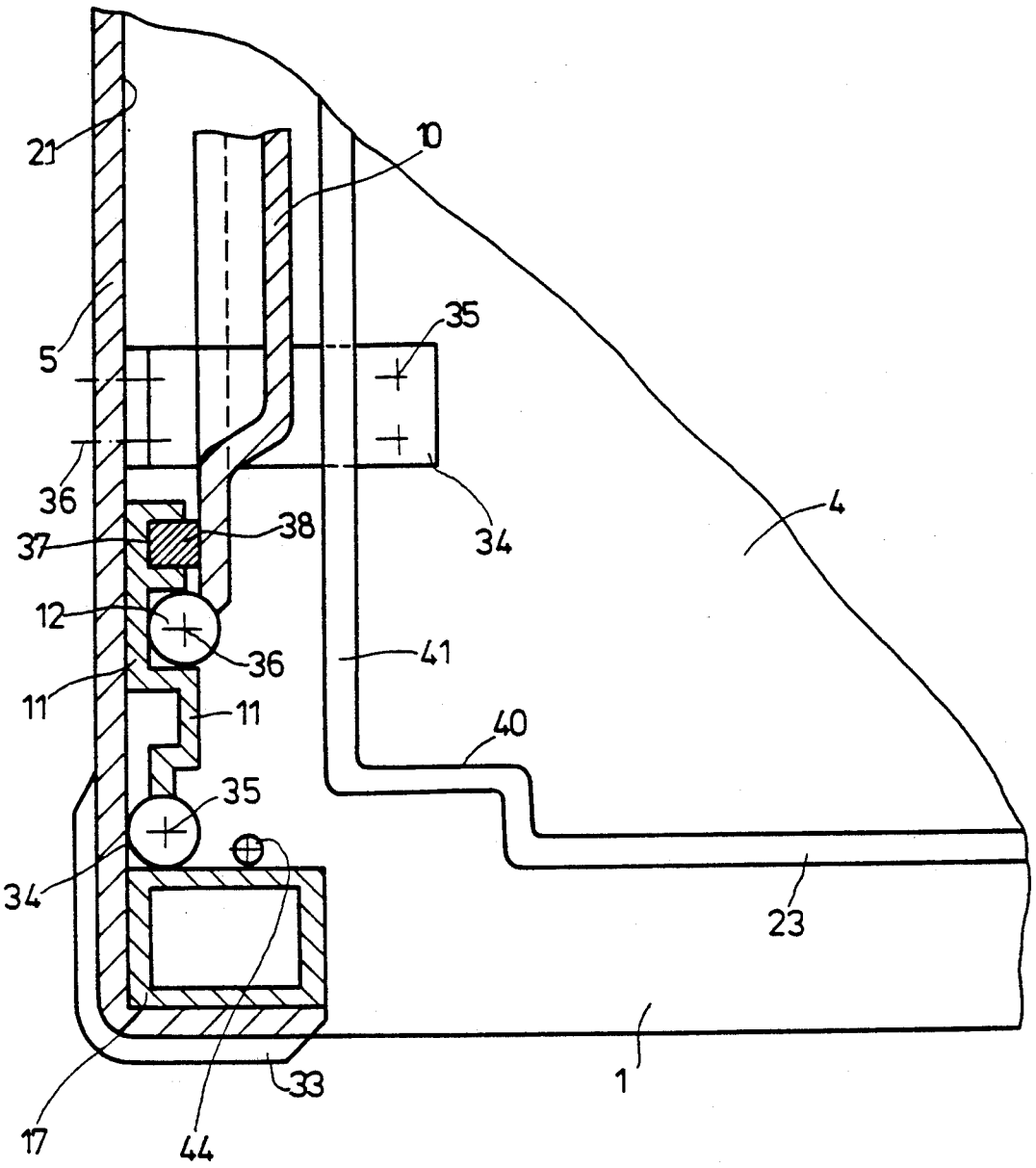
FIG. 13, in a corresponding fragmentary view, shows the arrangement of FIG. 11 with the door in the folded-in position.

Instead of the straps 29, other suitable connection means may also be used in order to join the side wall elements 5 to the bottom element or the top element 6 in captive fashion. Such connection means may for instance include securing chains or flexible strips. An alternative solution of this kind is shown in FIG. 13: For each wall element 5, one flexible strip 34 is fastened at one end at 35 to the bottom element 1; on its other end at 36 it is joined to the applicable wall element 5. The flexible strip 34 likewise makes it possible to lift the protrusions 19 of the wall element 5 out of the holes 20 in the bottom element 1 (FIG. 9) and then to place the wall element on the bottom element 1. Strip 34 can be a living hinge.

Figure 11:
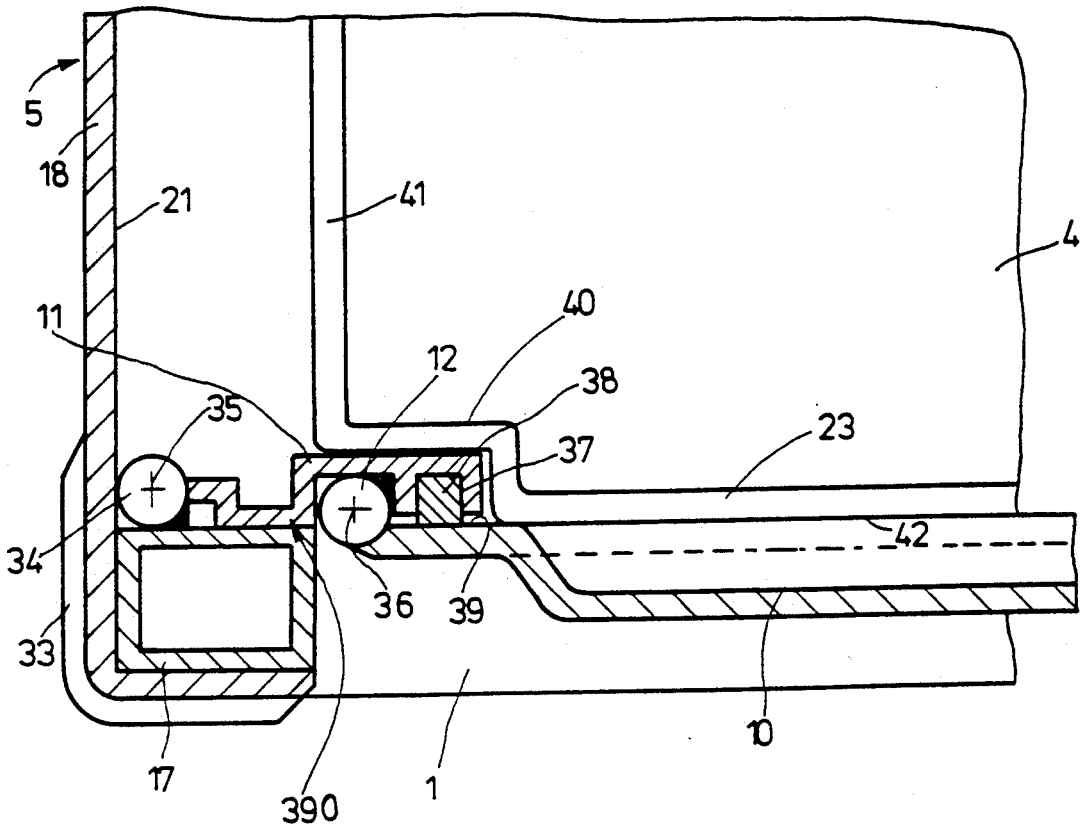
FIG. 11, in a fragmentary top view, shows the arrangement of FIG. 8, in a section taken along the line XI—XI of FIG. 8, showing the door in the closed position.
Figure 12:
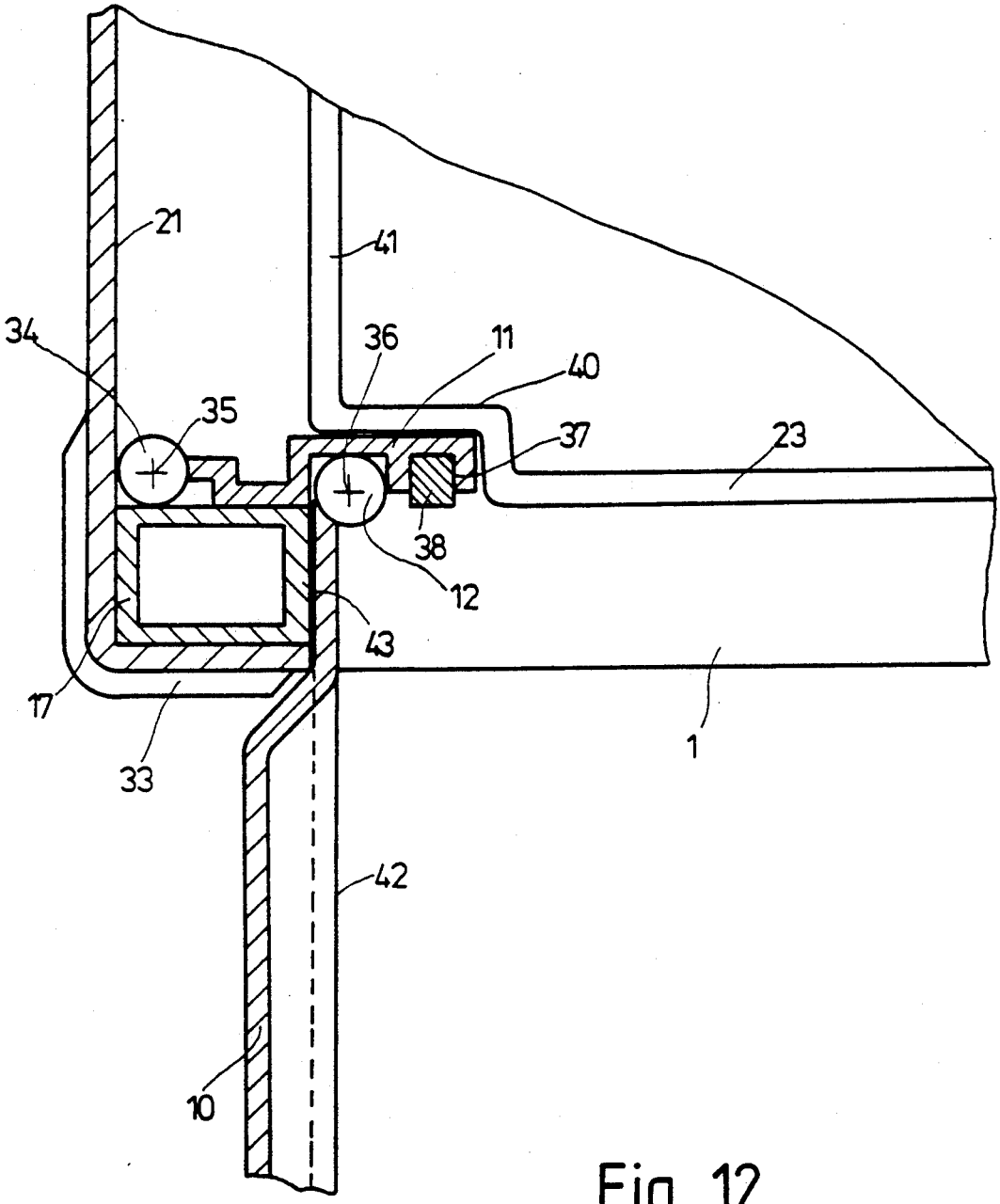
FIG. 12, in a corresponding fragmentary view, shows the arrangement of FIG. 11 with the door in the fully opened position.

FIGS. 11–13, in particular, show the precise structural layout of the striplike hinge elements 11:

Each of the hinge elements 11 is manufactured in the form of a profiled rail, preferably of aluminum or a fiber-reinforced plastic, and rotatably supported on the profile section 17, which is in the form of a rectangular-profile tube, by means of a hinge 34, whose vertical hinge axis is suggested at 35 (FIG. 11). The profile section 17 is encompassed on two sides by the plastic material of the wall element 5, and the hinge 34 is located in the corner region between the profile section 17 and the inside wall face 21. The door 10 is attached to the hinge element 11 by means of the hinge 12, whose vertical axis, parallel to the hinge axis 35, is shown at 36 and which extends laterally spaced a short distance apart from and next to the profile section 17. The hinge element 11 is also embodied with a groove 37 open at the periphery, into which an elastic sealing strip 38, optionally profiled as a lip seal, is replaceably placed; this sealing strip cooperates with a corresponding sealing face 39 on the door 10 in such a way that when the door 10 is closed, effective sealing of the container interior from splashing water and dust is assured in this region. Moreover, in for use shown in FIG. 11, the hinge element 11 rests against a stop face 390 against the inwardly oriented side face of the profile section 17, and it is thereby positionally fixed to prevent swiveling outward about the hinge axis 35. In the region of the stop face 390, if necessary, a similar sealing strip to the one at 38 may be provided, which suitably cooperates with the profile section 17 and also produces sealing in this region.

Suitable material for these sealing strips (such as 38) are sponge rubber coated with cork, in order to prevent the doors 10 from freezing shut, particularly if the cargo container will be stored in the open. Other suitable and practical sealing materials are naturally also possible.

The stop strip 23 located on the bottom face 4 of the bottom element 1 is closed off all the way around, as can be seen in FIGS. 11–13, with segments that extend substantially parallel to the side wall elements 5 and to the closed doors 10. In the region of each hinge element 11, this stop strip 23 is recessed inward at 40, far enough that in the erected state of use of the cargo container, it simultaneously acts as an inner stop for the sealing element 11. The sealing element 11 is thus locked in a fixed position, in the position for use shown in FIGS. 11, 12, between the part 40 of the stop strip 23 and the inside face of the profile section 17 against which it rests via the stop face 390.

By its segment 41 that is parallel to the applicable wall element 5, the stop strip 23 also extends at a distance from the inside face 21 of that wall element such that when the doors 10 have been folded into the wall element 5, they are locked in a positionally retained manner, together with the hinge element 11. This is especially significant if the cargo container is to be used for loading or unloading with the doors 10 in the recessed, folded-in condition, as has already been explained in conjunction with FIG. 4.

To assure closure of the doors so that it is sealed against splashing water and is dustproof in the region of the door gaps as well, a sealing strip similar to the sealing strip 38 may be provided either on the door 10 or on the closure strip 23 in the region in which it cooperates with the door 10. Each door may also have a frame seal that is closed all the way around on its inside, and it then rests with this frame seal against corresponding sealing strips on the hinge element 11 and stop strip 23 of the bottom element 1 and a correspondingly formed stop strip on the closure face 22 of the top element 6.

FIG. 11 shows the door 10 in the closed state; the profiled door leaf, which may optionally be provided with reinforcement ribs, rests at 42 on the stop strip 23. The hinge element 11 is locked in a fixed position, as explained.

In FIG. 12, the door 10 is shown in the fully open position; the opening angle is approximately 90° to 100°, which is normally adequate. Naturally, the opening angle may also be selected to be larger if that should be necessary in an individual case. To do so, the hinge axis 36 need merely be shifted farther toward the front of the cargo container, and/or the profile section 17 may be altered in its shape. The profile section 17 and thus the side wall element 5, in this position, simultaneously form the door jamb at 43.

In FIG. 13, finally, the door 10 is shown with the hinge element 11, in the sunken position in which it is folded into the wall element 5; as already noted, in this position, it is locked in a positionally fixed manner by the segment 41 of the stop strip 23 while the cargo container is in the erected condition.

The stop strip 23 extending all the way around forms a self-contained drainage wall on the bottom face 4 that prevents condensation, forming the inside faces 21 and collecting on the bottom face, from getting into the interior of the cargo container. At the same time, it acts as an additional reinforcement rib for the bottom element 1. To assure unhindered runoff of any condensed water collecting on the bottom face 4, the bottom element 1 is provided with a drainage device in the form of at least one drainage hole 4, which discharges into the space defined by the stop strip 23 and the side wall elements 5 (FIG. 13).

The hinges 12, 34 may intrinsically be formed arbitrarily, in the form of conventional hinge flaps. However, it is practical to make these hinges separable, in such a way that if repairs are needed, for instance, the doors 10 can be separated from the hinge elements 11 and/or the hinge elements 11 can be separated from the side wall elements 5 at the hinges 34 and thus removed from the cargo container.

Figure 15:
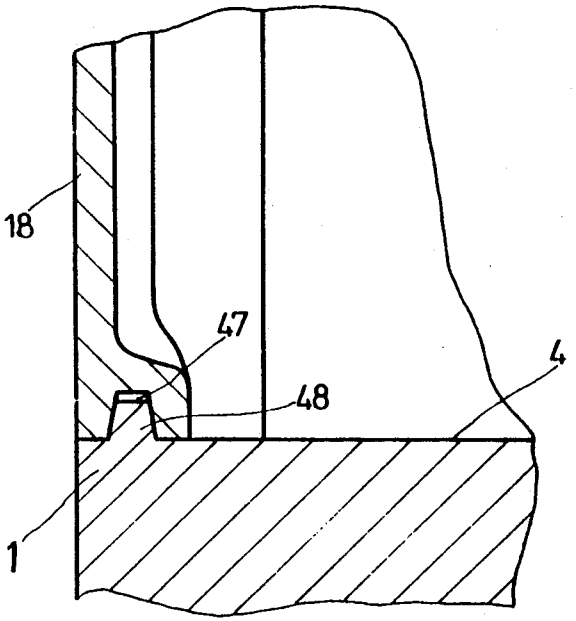
FIG. 15, in a corresponding detailed view, shows a detail in the region where a side wall element is connected to the bottom element of the modified embodiment of the freight container of FIG. 1 as shown in FIG. 14.
Figure 14:
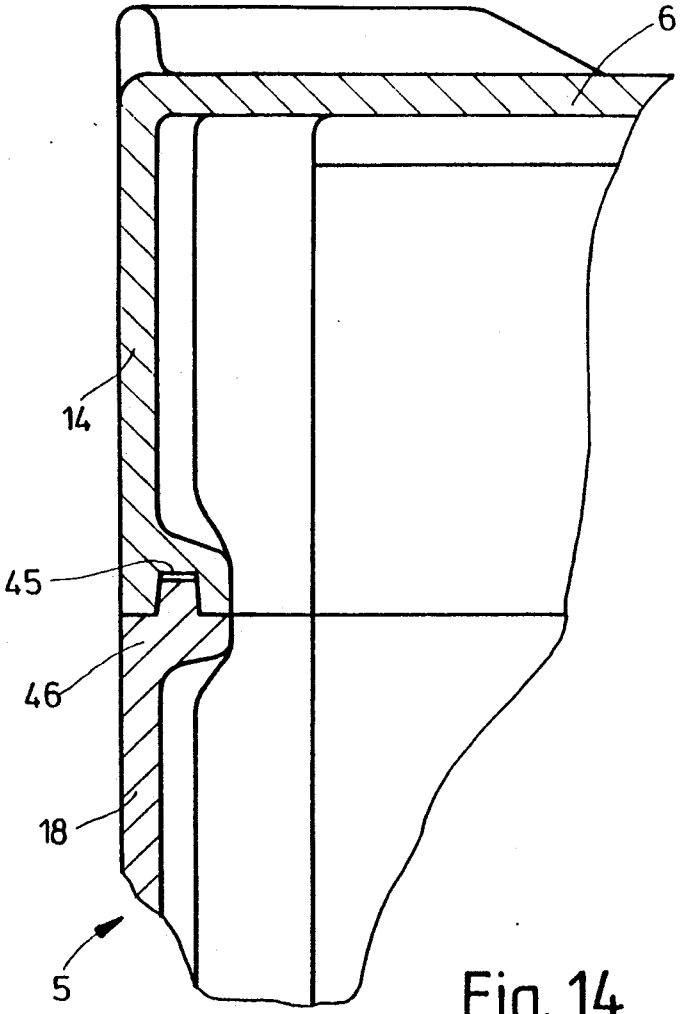
FIG. 14, in a fragmentary sectional view, shows a detail in the region where the top element is connected to a wall element, in a modified embodiment of the cargo container of FIG. 1.

In the basic embodiment of the cargo container, shown rather schematically in FIGS. 1–7, the wall elements 5 and the top element 6 along with the bottom element 1 have flat sides, as seen for instance in FIG. 3, with sides that abut one another in the erected state for use. This is adequate for many uses of the cargo container. However, if improved sealing conditions in the region of these separating lines is important, or if it is important to gain additional stability, then a form-fitting connection of the aforementioned elements in the region of the separating lines is to be preferred. One example of this is shown in FIGS. 14 and 15:

A groove and tongue connection is provided in the region of the abutting faces between the side wall 14 of the top element 6 and the wall panel 18 of the applicable side wall element 5; this connection comprises a groove 45, disposed in the side wall 14, and a tongue 46 meshing with it on the wall panel 18. A corresponding tongue-and-groove connection is also provided between the bottom element 1 and the wall panel 18 of the applicable side wall element 5 (see FIG. 15); the groove in the wall panel 18 is indicated by reference numeral 47, while the tongue in the bottom element 1 that meshes with it is shown at 48.

Sealing elements similar to the sealing strip 38 (FIG. 11) may naturally be placed in the grooves 45, 47 as well, should that prove suitable in an individual case. Alternatively, instead of the aforementioned tongue-and-groove connections, labyrinth seals or the like may also be provided.

Figure 16:
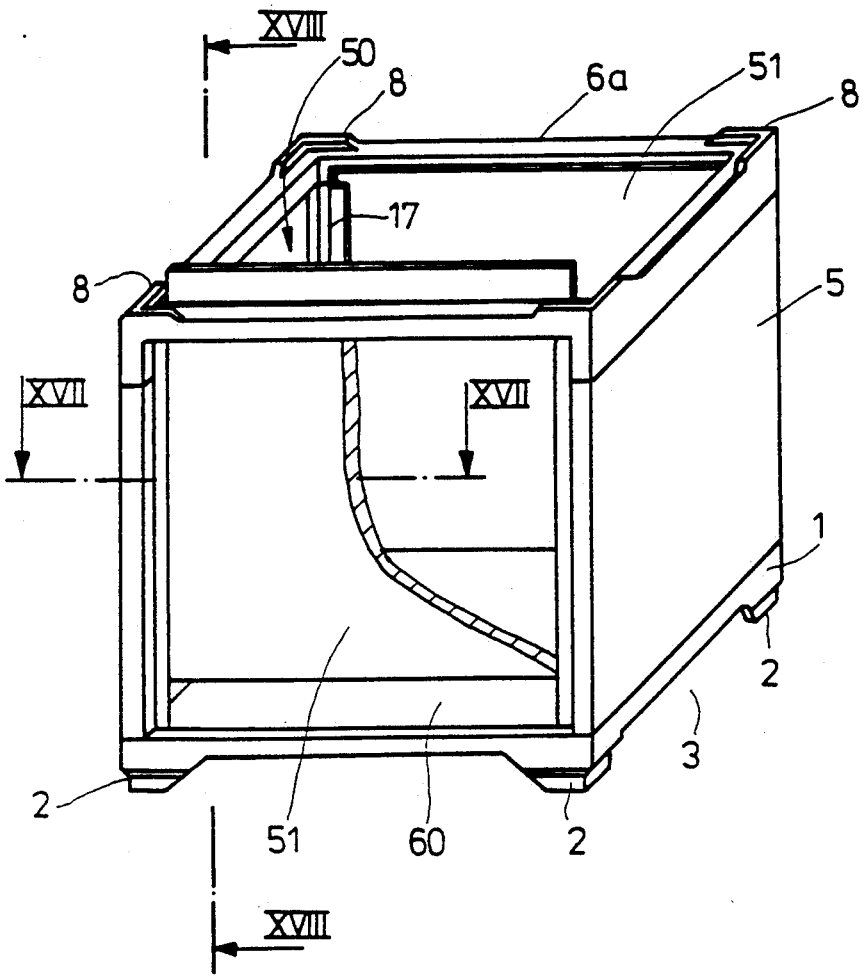
FIG. 16, in a schematic perspective view, shows a cargo container or small container according to the invention in a further modified embodiment.

In the embodiment of the cargo container described, the top element 6 is closed, with a flat outer surface (FIG. 1) or an outer surface 7 (FIG. 10) that is curved or gabled upward slightly. For certain uses, for example when the container is to be used like a chest or basket, it may be practical, however, for the top element 6 to be open in form, as shown in FIG. 16. The top element **6*a* here is constructed in the form of an open frame, which surrounds an access opening 50 and is otherwise—except for the missing counter face 7—identical to the construction of the top element 6** described for the preceding embodiments. Identical parts are therefore provided with the same reference numerals and are therefore not described again.

Figure 17:
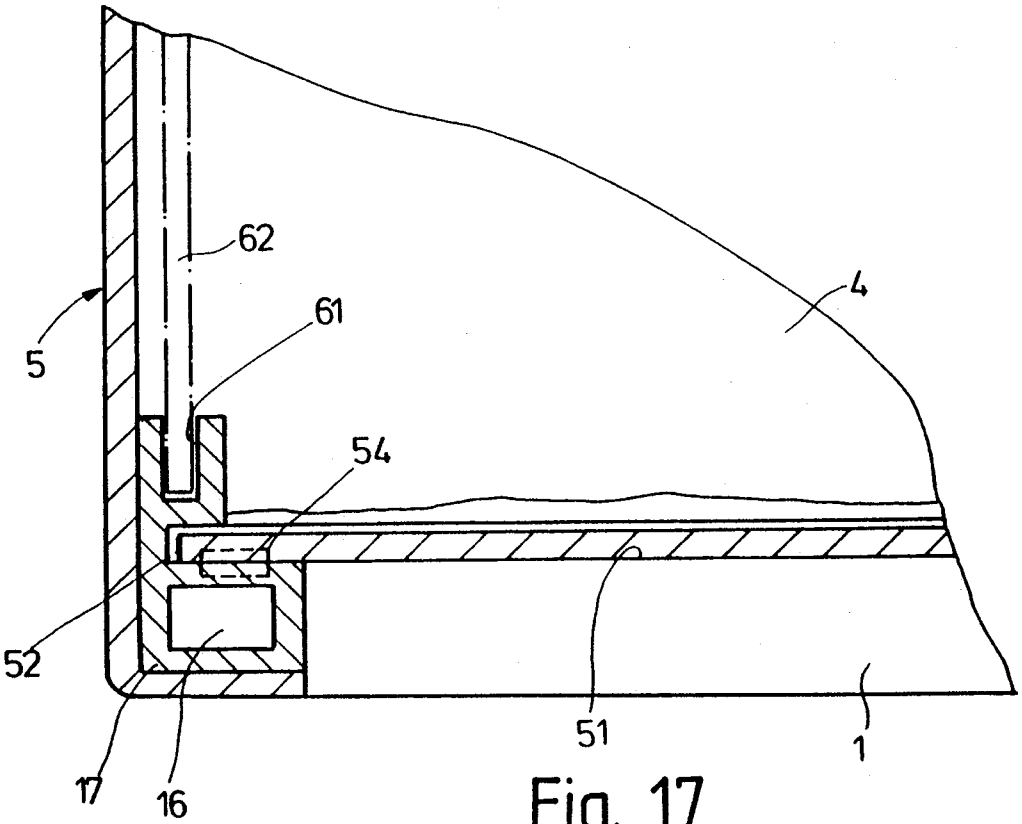
FIG. 17, in a top view on a different scale, shows a detail of the cargo container of FIG. 16, in a section taken along the line XVII—XVII of FIG. 16.
Figure 18:
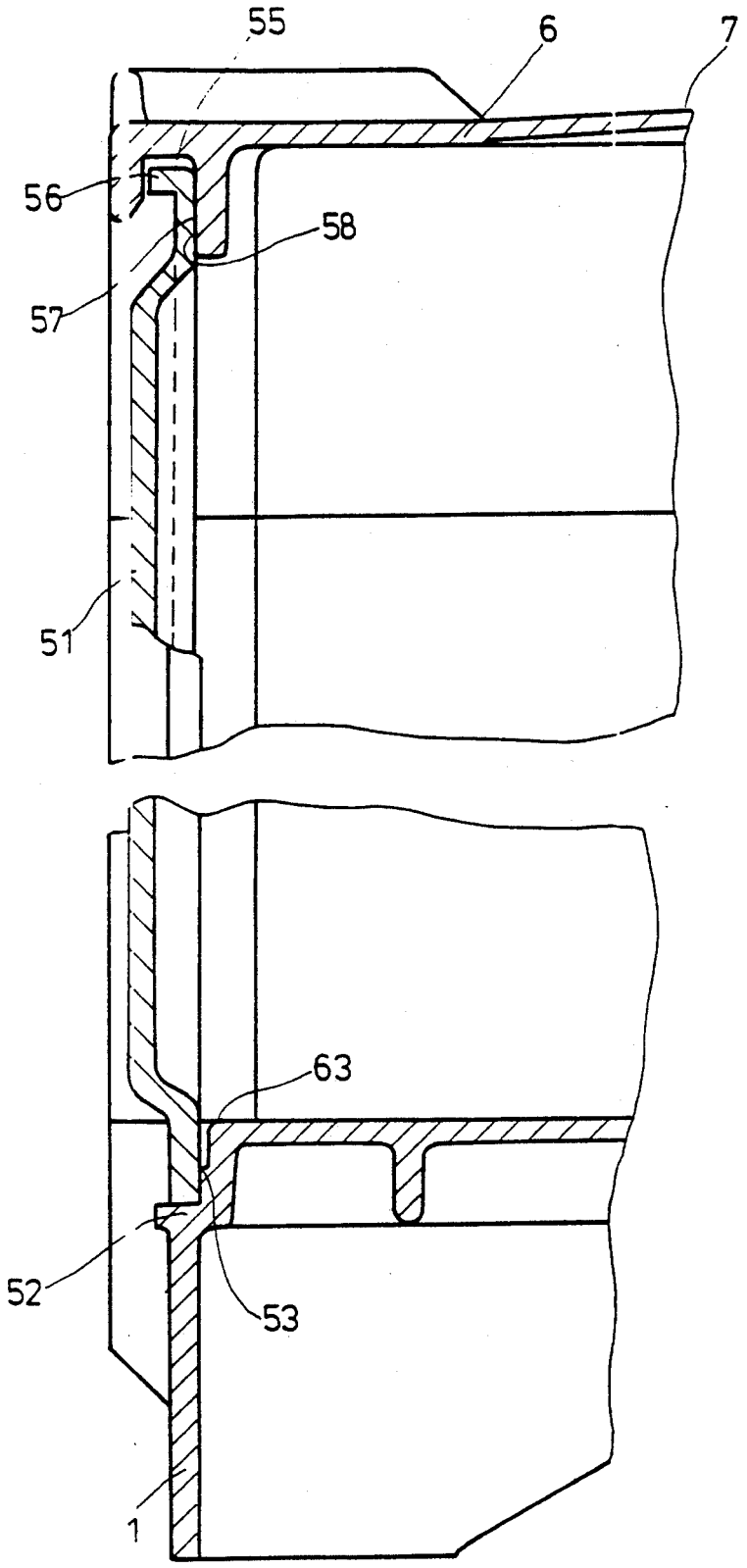
FIG. 18, in a top view on a different scale, shows a detail of the cargo container of FIG. 16, in a section taken along the line XVIII—XVIII of FIG. 16.

The cargo container provided with this kind of frame-like top element **6*a* can also be provided with doors 10 as in the embodiments described, but—again as in the other embodiments—a differently formed closing part may also be used. One example of this is shown in FIGS. 16–18 in the form of an embodiment of the cargo container that is especially suitable for holding bulk goods, in which two closing parts in the form of two sliding panels 51 are provided. These sliding panels 51, forming the front and back walls, are inserted into corresponding vertical guide grooves 52 (FIG. 17) of the profile sections 17 forming parts of the side wall elements 5, thus producing appropriate slide guides, in which they can be displaced arbitrarily far upward. As shown in FIG. 18, a bearing edge 52 for each sliding panel 51 is formed on the bottom element 1; adjoining this bearing edge 52 is a vertical sealing face 53 that supports the sliding panel 51 toward the inside and at the same time, together with the bearing edge 52, forms a double face seal. If necessary, sealing strips similar to the sealing strip 38 (FIG. 11) may also be disposed in the bottom element 1 in this region, and corresponding sealing strips may optionally be associated with them in the region of the guide grooves 52, as shown in dashes lines at 54 in FIG. 17**.

Fundamentally similar conditions may also prevail in the region of the top element 6 (FIG. 18) or of the top element **6*a* (FIG. 16). As can be seen in FIG. 18, the top element 6 is formed with one groove 55 on each of the face ends in the region of its outer periphery; in the closed state, this groove fits over the sliding panel 51, which is provided with a handle 56. The sliding panel 51 is supported at 57 against a suitable stop face 58 of the top element 6**, which if necessary may also be embodied by the aforementioned sealing strips. However, in this version as a rule, an additional provision for sealing against splashing water is not necessary.

In the version of FIG. 18, the sliding panel is automatically secured in the closed state by the top element 6, so that actuation is not possible unless the top element 6 is removed. This version is especially appropriate for cargo containers intended for the shipment of small loads.

By comparison, FIG. 16 shows a variant in which the essentially flat panel 51 can be pulled arbitrarily far out at the top without hindrance while the top element 6a is in place, so that an adjustable gap 60 results at its lower edge. When used for shipping bulk goods, for which this embodiment is especially intended, the bulk goods can then be allowed to run out through the gap 60 in this way—optionally with suitable tilting of the cargo container.

For storage of the sliding panel 51 in the empty shipment position, an additional sliding panel guide is formed onto each of the profile sections 17, as shown in FIG. 17; each guide is formed by a further guide groove 61, extending at right angles to the guide groove 62, and the sliding panel, shown in dot-dashed lines at 62, is inserted into this groove 61.

Any condensed water forming on the inside of the sliding panel 51, for instance, can be removed to the outside via a gutter 63 (FIG. 18), molded into the bottom assembly, and an additional drainage device may also be associated with this gutter.

If the stop strip 23 that extends all the way around is used (see FIG. 11, for example), then the dimensions of the side wall elements 5 can be selected such that when the side wall elements 5 are placed on the bottom element, the stop strip 23 simultaneously also serves as a lateral retaining means for the side wall element 5 resting on it. The raising of the side wall elements 5 as already described is desirable because of the stop strip 23 protruding past the flat bottom face 4 for folding the doors 10 into the sunken position of FIG. 5. It is not necessary.

To this end, the hinges 12 and/or 34 (FIG. 11) may for instance be formed such that they enable a limited vertical movement of the applicable door 10 and/or the associated hinge element 11 relative to the bottom element 1, making it possible to raise the door 10 far enough that it can be swiveled past the stop strip 23.

Figure 19:
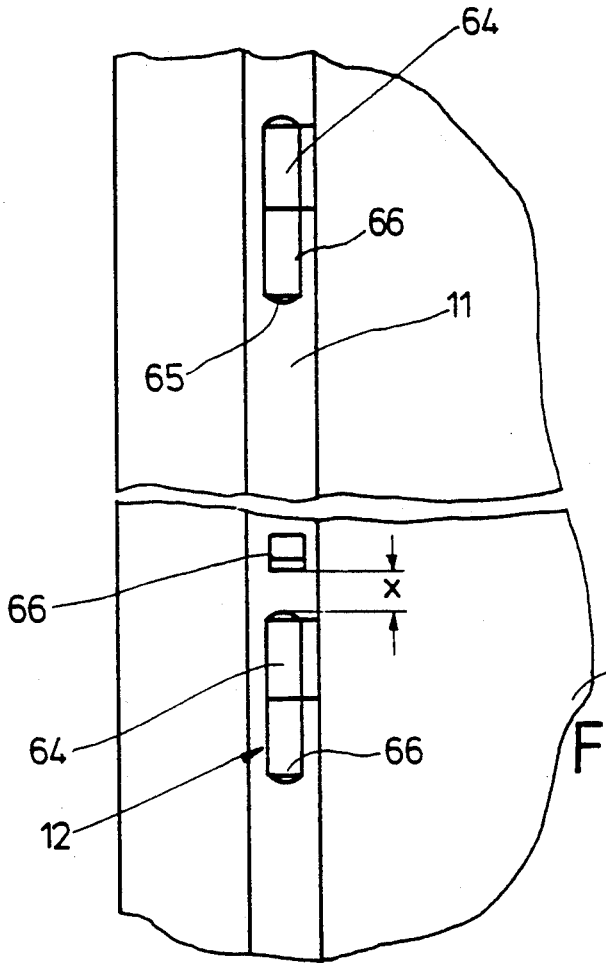
FIG. 19, in a side view of the cargo container of FIG. 1, shows a detail on a different scale of a modified embodiment of the hinge suspension of the doors of the cargo container of FIG. 1.

An embodiment that functions in this way is shown in FIG. 19:

The hinges 12, by which the door 10 is attached to the hinge element 11, each have a first hinge part 64, joined to the door 10 and rotatably supported on a hinge pin 65; the hinge pin is press-fitted into the other hinge part 66, which is joined to the hinge element 11. By the hinge parts 64 on the hinge pins 65, the door 10 can be displaced upward by an amount x that is defined by a stop, which is for instance in the form of a small angle iron 66 that is secured above a hinge 12 on the hinge element 11.

The dimension x corresponding to the maximum distance by which the door 10 is lifted up, is greater than the height of the stop strip 23.

The bottom element 1, the top element 6, and the wall elements 5, including the doors 10, are each integrally molded from plastic material in the embodiments described. This plastic material may be fiber-reinforced; as described, the elements may be defined with smooth walls or may have reinforcement ribs and elements, optionally located on the inside. Reinforcements in the form of frames, strips and the like may be embedded in the elements, and in that case metal, preferably aluminum, may be used for such load-bearing frame parts and reinforcements, particularly in the bottom assembly. The arrangement may be such that together with the profile sections 17, a stress-absorbing frame construction is obtained, in which the intervening wall parts or panels each essentially have merely an enveloping or enclosing function.

This does not make any limitation in the selection of material. In particular, metal constructions are also possible. Because of the simple design, the elements 1, 5, 6 may also be lined with a heat- or cold-insulating material on the inside or the outside, and it is also possible to provide special receptacles, for instance for yarn packages or the like, on the inside of the cargo container.

The external dimensions of the cargo container are preferably as follows:

length × width × height equals 120 × 115 × 118 cm, so that such containers can be accommodated in standardized transcontainers in an especially space-saving way.

Advantageously, the side wall elements 5 may have parallel pillar-like profile sections 17 on two opposed sides, with parts of the plug-in connectors optionally located on these profile sections. The profile sections 17 may either be formed directly in the material comprising the side wall element or molded onto it, and they may also be parts of an encompassing frame. On the other hand, the profile sections 17 may be of some other material, such as metal and in particular lightweight metal, and molded integrally with the side wall elements 6 or joined to them in some other suitable manner.

It is advantageous if the plug-in connectors have plug-in protrusions on one of the elements to be joined together, with receptacles for these protrusions on the other element. These protrusions not only enable simple manipulation but can also readily be made so stable that even after relatively long use of the cargo container, they assure perfect joining of the elements to one another.

The aforementioned profile sections may be located on the applicable side wall element in such a way that they protrude beyond the wall face, or in other words are raised; they may be in the form of open or closed hollow profile sections or tubes of round or other suitable cross-sectional shape.

As its closing part, the cargo container may have at least one door, which is supported to swivel about a hinge axis on a side wall element or some part connected to it, and which can be folded to lie flat against the side wall element in the shipping condition. If the profile sections are made to protrude past the wall face, as mentioned above, then the door may be made foldable in sunken fashion into the recessed region of the applicable side wall element defined by the two protruding profile sections, so that the wall element, together with the folded-in door, or two folded-in doors, forms a substantially flat panel, which in the empty shipping state can be securely accommodated, extending only slightly upward, between the bottom and top elements, without the danger of damage to any protruding parts.

It is advantageous if hinge elements that each have two parallel hinge axes are joined to the profile sections or the side wall elements; one of these axes enables swiveling of the hinge element relative to the side wall element, while the other is associated with the door. To increase the stability of the cargo container in the erected state for use, each hinge element may be lockable in at least one position. Embodiments are also possible in which the hinge element is releaseably secured to the applicable side wall element or its profile section, in such a way that the door can easily be removed, if the cargo container, for certain purposes, should be used in such a way that it is open at the end on one or both sides.

Sealing means may be disposed between the hinge element and the associated profile section or side wall element, and between the at least one door and the hinge element and/or profile section and/or bottom or top element; similarly, it is also possible to provide sealing means between the bottom and/or top element and the side wall elements, if that appears necessary, so that the goods to be shipped in the cargo container will be sealed off in a dustproof and/or splashing-waterproof manner.

In a modified embodiment, which is appropriate especially for shipping bulk goods, the at least one closing part may also be formed as a sliding panel, which is displaceably guided in guide means of the side element and/or of the bottom and/or top element, or parts joined to them. In the closing position, this sliding panel can be locked by means of the bottom and/or top element, but it is also possible to provide it with its own locking means. The top and/or bottom elements are as a rule embodied as closed, at least in the region of the bottom and top face. Depending on the intended use, it is also possible for one or both of these elements to be in the form of a frame, so that the top or bottom face includes one or more small or larger openings.

Stop means for a closing part (door, sliding panel, rolling shutter, shade, etc.) may be disposed on the bottom and/or the top element. At least on the bottom element, these stop means may have a preferably molded-on, raised stop strip; however, they may also be embodied by at least one stop shoulder. It has proved to be advantageous if when the stop means is embodied as a stop strip, formed so as to be closed all the way around, and that the closing part, folded onto the side wall element, is fixable in this position by the stop means 23. The aforementioned hinge element may also be fixable by this stop strip in a given position. Moreover, the location and formation of this stop strip 23 may be selected such that the side wall elements, laid in place along with the applicable closing part between the bottom and top elements in the empty shipment state are retained laterally immovably between the bottom and top elements.

Especially in the cases in which it is important to seal the container interior tightly from splashing water, it is advantageous if a chamber of the bottom element, defined by the stop means, has a drainage device leading outward, which assures that under extreme usage conditions condensation that forms on the inside wall of the container and runs down along the vertical surfaces of the inner wall collects in the aforementioned peripheral chamber of the bottom element, and from there it is removed to the outside via the drainage device, without being able to affect the goods being shipped.

The at least one closing part, for instance in the form of a door, may be of equal height to the side wall elements. However, in certain cases, it is advantageous if the at least one closing part has a height that differs from the height of the side wall elements 5; the bottom and/or top element may be provided in the region of the side wall elements, or of the closing part with protruding or recessed side wall parts, which adjoin the side wall parts or the at least one closing part in the erected state of the cargo container.

A particularly useful embodiment of the novel cargo container is distinguished by the fact that the side wall elements 5 are joined to the bottom and/or top elements 1, 6 in captive fashion by connection means 29, 34 that are formed to permit converting the side wall elements 5 from the erected position to the collapsed position. In this way it is automatically assured that upon conversion to the collapsed position for shipment-empty, the side wall elements 5 will come to rest correctly positioned with respect to the bottom and top elements 1, 6. To this end, the connection means may have straplike connection elements 29, located in the region of the face ends of the side wall elements; these connection elements are swivelable at the bottom or top element 1, 6 and the applicable side wall element 5 and are supported so as to be limitedly longitudinally displaceable on at least one of these elements. These straplike connection means 29 not only form guide means for the side wall elements 5 when the container is being folded down or erected, but they can also act simultaneously as reinforcement elements for the erected cargo container. If it appears desirable to avoid outwardly protruding parts, then the connection means 29 may also be sunken.

In another embodiment, the connection means may also have at least one striplike element 34, preferably elastic, which is joined to the bottom or top element 1, 6 and to which the applicable side wall element 5 is coupled.

It is often sufficient for the side wall elements 5 to meet the bottom and top elements in a butt joint. To increase the stability of the cargo container in the erected state and to improve sealing conditions, however, it may be useful to provide form-fittingly interlocking connection members 45, 46, 47, 48, which may for instance be in the form of a tongue-and-groove connection, between the bottom and/or top element and the side wall elements.

At least in the corner regions, the bottom element 1 may have feet 2 to stand on, which enable transporting the cargo container from all sides using a forklift, or to park it on a wet surface. These feet 2 may be formed on or may be attached as separate parts. To save space in the warehouse or in shipping, it is often desirable for several such cargo containers to be stackable on one another. This is readily possible. To assure a secure hold of the stacked containers, the top element 6 may have guide means 8, at least in the corner regions, for the feet 2 of a second cargo container stacked on it. To protect the cargo container, particularly in cases where rough use is to be expected, the top element 6 and/or the bottom element 1 and/or at least one of the side wall elements 5 may have lateral impact absorbers 33. Since the novel cargo containers offer three-dimensional shapes that are defined outwardly in substantially flat surfaces, of rectangular or square cross section, advantages arise for optimal use of shipping space. As an example, a cargo container of this kind, in the erected state, has substantially the following external dimensions:

Length: 120 cm
Width: 115 cm
Height: 118 cm.

These external dimensions make it possible for two cargo containers at a time to be accommodated side by side and one on top of other in a standardized transcontainer.

The plug-in connectors provided on the corners of the bottom and top elements 3 and 6, may be formed differently, for instance such that the bottom element 1 is provided with protrusions 19 that engage corresponding receptacles 20 in the profile sections 17 or side wall elements 5. The bottom element itself may if necessary also have a tublike bottom face 4 on the inside, and in general, be shaped for adaptation to the most various uses and to many kinds of goods to be shipped.

The top element 6 and/or the bottom element 1 and the wall elements 5 may if necessary also be formed to be bullet-proof, so that the cargo container can also be used for military purposes.

We claim:

1. A collapsible cargo container, in particular of rectangular or square cross section, having a bottom element (1);

a plurality of side wall elements (5); and a top element (6), said bottom side wall and top element being rigidly joined together when said container is in an erected condition;

at least one selectively openable and closable door;

a door hinge (11) pivotably supporting the door about a vertical hinge axis when the container is in erected condition; and releasable plug-in connectors located in the corner regions of the bottom and top elements for connecting the bottom and top elements to the side wall elements, wherein the plug-in connectors (15, 16; 19, 20), when the container is in a collapsed or empty shipping condition, directly connect the top element (6) to the bottom element (1) with the side walls elements (5) located between the top and bottom elements; and wherein the door hinge (11) is coupled to one side wall element (5) and is hingedly operative to fold the door (10) flat against said one side wall element for resting against said one side wall element flat thereagainst to be accomodated between the top element (6) and the bottom element (1) when the container is collapsed for empty-shipment.

2. The cargo container of claim 1, wherein the plug-in connectors have plug-in protrusions (15, 19) on one of the elements (1, 5, 6) to be joined together, and receptacles (16, 20) for the plug-in protrusions on the other element.

3. The cargo container of claim 1, wherein the side wall elements (5), on two opposed sides, have parallel pillar-like sections (17).

4. The cargo container of claim 3, wherein the pillar-type sections (17), located on the adjacent respective side wall elements (5), protrude beyond the wall face of the respective side wall element, and define recessed regions of the respective side wall element adjacent the associated pillar-like section (17).

5. The cargo container of claim 3, wherein parts of the plug-in connectors (15, 16; 19, 20) are located at end regions of said pillar-like sections (17).

6. The cargo container of claim 4, wherein the recessed region of the respective side wall element, defined by the side wall element and the two adjacent protruding pillar-like sections, is dimensioned to receive the at least one door (10) into said recessed region.

7. The cargo container of claim 3, wherein the profile sections (17) are formed as hollow profile sections or tubes.

8. The cargo container of claim 1, wherein at least two hinge elements (11) are provided, each hinge element having two parallel hinge axes (35, 36), and joined to the pillar-like sections (17) and the side wall element (5) respectively, of which one hinge axis is located so as to enable swiveling of the hinge element (11) relative to the side wall element (5), and the other axis (36) is positioned on the respective hinge element so as to enable swinging of the door (10).

9. The cargo container of claim 8, wherein the hinge elements (11) are releasably secured to the applicable side wall elements (5) or its pillar-like profile section (17).

10. The cargo container of claim 1, wherein sealing means are provided, located between the door (10) and at least one of: the respective hinge element (11), and the bottom wall element (1), and the top element (6).

11. The cargo container of claim 1, wherein door stop means (23; 52, 53) for the at least one door (10; 51) are provided, located on at least on of: the bottom element (1) and the top element (6).

12. The cargo container of claim 11, wherein the stop means (23) locks the hinge element (11) in position.

13. The cargo container of claim 1, wherein the at least one door (10) has a height differing from the height of the side wall elements (5), and that at least one of: the top element and bottom element (1; 6) is provided, respectively, with protruding or recessed side wall parts which, in erected condition of the cargo container, adjoin the side wall elements (5) or the at least one door (10), respectively.

14. The cargo container of claim 1, further including coupling or connection means (29; 34) coupling the side wall elements (5) to one of the bottom element (1), and the top element (6) to retain the side wall elements captive with the respective bottom or top element, said coupling or connection means permitting movement of the side wall elements (5) from the erected position into the collapsed position for empty shipping of the container in collapsed condition.

15. The cargo container of claim 14, wherein the coupling or connection means comprise strap-like connection elements (29), locted in the region of the face ends of the side wall elements (5), which connection elements are hinged on the respective bottom or top element (1, 6) and the respective side wall element (5) and further are longitudinally displaceable to a limited extent with respect to at least one of the said elements.

16. The cargo container of claim 14, wherein the coupling or connection means (29) are recessed.

17. The cargo container of claim 14, wherein the connection means comprise at least one, optionally elastic, strip-like element (34), connected to the respective bottom or top element (1, 6), and to the associated side wall element (5).

18. The cargo container of claim 1, wherein form-fittingly interengaging connection members (45, 46; 47; 48) are provided, located between the at least one of: the bottom element (1), and the top element (6) respectively and each of said side wall elements (5).

19. The cargo container of claim 1, wherein the bottom element (1) is formed with feet (2) to stand on, positioned at least in corner regions thereof; and wherein the top element (6) has guide means (8), at least in the corner regions, for the feet (2) of another cargo container stacked on it.

20. The cargo container of claim 1, wherein at least one of the top element (6) and the bottom element (1) and at least one of the side wall elements (5) has lateral impact absorbers (33).

21. The cargo container of claim 1, wherein at least one of the top and the bottom element (6*a*, 1) is formed as a frame.

22. The cargo container of claim 1, wherein at least one of the side wall element (5) and the bottom element (1) and the top element (6) is at least substantially formed of plastic material.

23. The cargo container of claim 1, wherein at least one of the top element, and the bottom element (6, 1), and at least one of the wall elements (5) are essentially bullet-proof.

24. The cargo container of claim 11, wherein the stop means comprises a raised stop strip (23) formed on at least one of: the bottom element (1), and the top element (6), and located to retain the door (10) in position against the respective adjacent side wall (5).

25. The cargo container of claim 11, wherein the stop means (23) is located on the bottom element (1) and defines an included space; and wherein a drainage device (44) is provided connected to said included space and leading to the outside thereof.

26. The cargo container of claim 1, wherein at least one of said doors is formed as a sliding panel (51); and guide means (52) are provided on at least one of: the side wall element (5), the top element (1), and the bottom element (6) for displaceably guiding said sliding panel (51).

27. The cargo container of claim 1, wherein said door hinge is hingedly operative to fold the door (10) flat, inwardly of the container, against said one side wall element (5).

* * * * *